US010494151B2

(12) United States Patent
Oakes

(10) Patent No.: US 10,494,151 B2
(45) Date of Patent: Dec. 3, 2019

(54) RECLOSABLE CUP LID

(71) Applicant: GPCP IP Holdings LLC, Atlanta, GA (US)

(72) Inventor: Shawn A. Oakes, Ripon, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 732 days.

(21) Appl. No.: 14/242,475

(22) Filed: Apr. 1, 2014

(65) Prior Publication Data

US 2015/0272359 A1 Oct. 1, 2015

(51) Int. Cl.

*B65D 47/26* (2006.01)
*B65D 39/00* (2006.01)
*B65D 43/02* (2006.01)

(52) U.S. Cl.

CPC ..... *B65D 39/00* (2013.01); *B65D 43/0212* (2013.01); *B65D 2251/0012* (2013.01); *B65D 2251/0081* (2013.01)

(58) Field of Classification Search

USPC ..... 220/254.9, 345.4, 713, 714, 715, 254.4, 220/711, 213, 253, 254.1, 259.5, 351; 229/906.1

See application file for complete search history.

(56) References Cited

U.S. PATENT DOCUMENTS 1,153,379 A * 9/1915 Frankenberg ..... B65D 47/265 222/545
2,104,806 A * 1/1938 McNeil ..... 222/512
4,170,724 A 10/1979 Waterbury et al.
4,171,060 A 10/1979 Howard et al.
4,579,245 A 4/1986 Narushko
4,712,704 A 12/1987 Ramsey et al.
5,143,248 A 9/1992 Sawatsky et al.
5,148,936 A 9/1992 DeGrow et al.
5,294,014 A 3/1994 Wyatt et al.
6,003,711 A * 12/1999 Bilewitz ..... 220/253
6,220,470 B1 4/2001 McHenry et al.
D477,223 S 7/2003 Smith et al.

(Continued)

FOREIGN PATENT DOCUMENTS

JP 11240555 A 9/1999
WO 2007/052014 A1 5/2007
WO 2014014844 A1 1/2014

OTHER PUBLICATIONS

International Search Report for International Application No. PCT/US2015/023611 dated Jul. 7, 2015.

(Continued)

*Primary Examiner* — Allan D Stevens

(57) ABSTRACT

A reclosable cup lid that can include an upper surface having at least one recess formed therein, that is arcuate in shape. The reclosable cup lid can also include a tab configured to fit within the recess. The tab having an arcuate shape corresponding to the arcuate shape of the recess. The reclosable cup lid can also include an opening disposed within the recess to allow fluid flow therethrough. The tab can be adapted to move within the recess from a first position to a second position so that the opening is at least partially blocked when the tab is located in the first position and the opening is at least partially unobstructed when the tab is located in the second position.

20 Claims, 11 Drawing Sheets

(56) References Cited

U.S. PATENT DOCUMENTS

| | | | | |
|---|---|---|---|---|
| 6,626,314 | B1 | 9/2003 | McHenry et al. | |
| 6,732,875 | B2 | 5/2004 | Smith et al. | |
| D514,444 | S | 2/2006 | Smith et al. | |
| 7,156,251 | B2 | 1/2007 | Smith et al. | |
| 7,159,732 | B2 | 1/2007 | Smith et al. | |
| 7,246,715 | B2 | 7/2007 | Smith et al. | |
| 7,513,382 | B2 | 4/2009 | Clarke et al. | |
| 7,594,584 | B2 | 9/2009 | Durdon et al. | |
| 7,731,047 | B2 * | 6/2010 | Ishimitsu | B65D 17/506 220/253 |
| 7,845,510 | B2 | 12/2010 | Schmidtner et al. | |
| 7,850,037 | B2 | 12/2010 | Schmidtner et al. | |
| 9,302,824 | B2 | 4/2016 | Eyal | |
| 2001/0013483 | A1 | 8/2001 | Konno et al. | |
| 2003/0089713 | A1 | 5/2003 | Belt et al. | |
| 2005/0242096 | A1 * | 11/2005 | Jaghab | B65D 47/265 220/254.8 |
| 2006/0261068 | A1 | 11/2006 | Schmidtner et al. | |
| 2007/0012698 | A1 | 1/2007 | Durdon et al. | |
| 2007/0278228 | A1 * | 12/2007 | Wong | 220/254.9 |
| 2008/0029512 | A1 | 2/2008 | Smith et al. | |
| 2011/0068113 | A1 | 3/2011 | Kim | |
| 2011/0089174 | A1 | 4/2011 | Smith et al. | |
| 2011/0174818 | A1 | 7/2011 | Holcomb et al. | |
| 2011/0198351 | A1 | 8/2011 | D'Amato | |
| 2014/0117016 | A1 | 5/2014 | Hodge | |
| 2015/0251818 | A1 | 9/2015 | Strachan et al. | |
| 2016/0058223 | A1 | 3/2016 | Savenok | |
| 2016/0325890 | A1 | 11/2016 | Hong | |

OTHER PUBLICATIONS

Written Opinion for International Application No. PCT/US2015/023611 dated Jul. 7, 2015.

* cited by examiner

RECLOSABLE CUP LID

BACKGROUND

Field

Embodiments described generally relate to disposable cup lids. More particularly, such embodiments relate to disposable cup lids having an opening that can be at least partially sealed to inhibit or prevent liquid from passing therethrough.

One conventional type of disposable cup lid is a "dome-shaped" cup lid. Dome-shaped cup lids include a substantially vertical sidewall that transitions to a substantially flat upper surface. The upper surface includes an opening through which a user can drink. The upper surface is vertically offset from the top of the cup, and this distance reduces the likelihood that liquid within the cup will spill or splash through the opening.

To further prevent spilling, some cup lids now have a closure panel coupled to the upper surface of the lid. The closure panel slides within grooves or tracks in the upper surface. The closure panel slides radially outward in a linear direction between a first position, in which the opening is uncovered, and a second position, in which the opening is covered by the panel. Lids with a closure panel can be difficult to operate and difficult to manufacture, as the closure panel usually requires manual insertion into the tracks.

There is a need, therefore, for an improved disposable cup lid having an opening that can be sealed to prevent liquid from passing therethrough.

SUMMARY

Reclosable cup lids are provided. In at least one specific embodiment, the reclosable cup lid can include an upper surface having at least one recess formed therein, the at least one recess having an arcuate shape. The reclosable cup lid can also include a tab configured to fit within the recess, the tab having an arcuate shape corresponding to the arcuate shape of the recess. The reclosable cup lid can also include an opening disposed within the recess to allow fluid flow therethrough. The tab can be adapted to move within the recess from a first position to a second position so that the opening is at least partially blocked when the tab is located in the first position and the opening is at least partially unobstructed when the tab is located in the second position.

In at least one other specific embodiment, the reclosable cup lid can include an upper surface, a first recess formed within the upper surface, a tab configured to fit within the first recess, the tab having a tab recess, a second recess formed within the upper surface adapted to provide a space for a user's nose, and an opening disposed within the first recess to allow fluid flow therethrough. The tab can be adapted to move within the first recess from a first position to a second position so that the opening is at least partially blocked when the tab is located in the first position and the opening is at least partially unobstructed when the tab is located in the second position.

In at least one other specific embodiment, the reclosable cup lid can include an upper surface, a first recess formed within the upper surface, a tab configured to fit within the first recess, a second recess formed within the upper surface adapted to provide a space for a user's nose, and an opening disposed within the first recess to allow fluid flow therethrough. The first recess can have an arcuate shape, a first radius of curvature, $R_1$, and a second radius of curvature, $R_2$. A ratio of $R_1$:$R_2$ can be about 1:1.1 to about 1:2.5. The tab can have a tab recess, a first radius of curvature, $R_3$, a second radius of curvature, $R_4$. A ratio of $R_3$:$R_4$ can be about 1:1.1 to about 1:2.5. The tab can be adapted to move within the first recess from a first position to a second position so that the opening is at least partially blocked when the tab is located in the first position and the opening is at least partially unobstructed when the tab is located in the second position.

DETAILED DESCRIPTION

Figure 1:
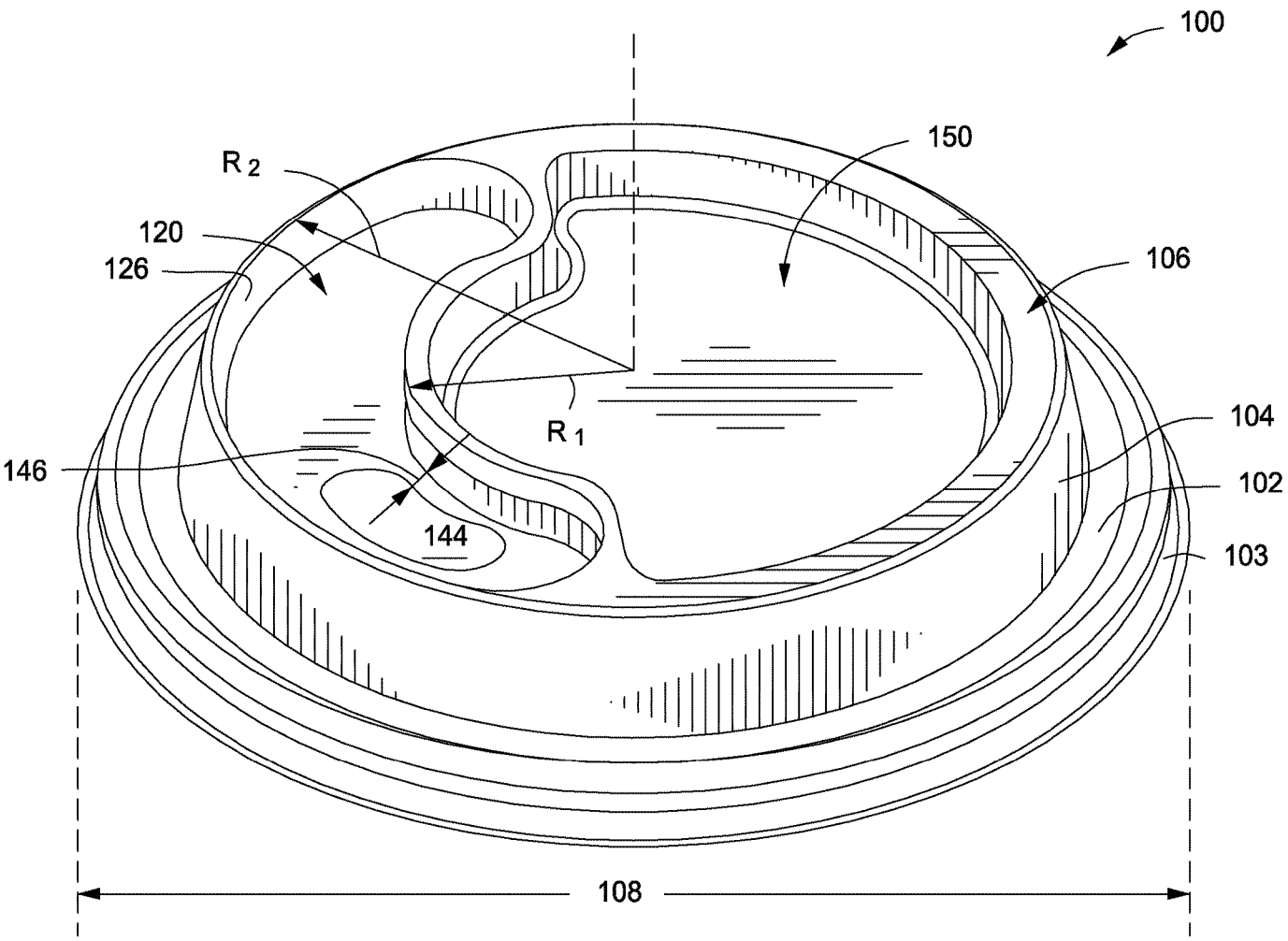
FIG. 1 depicts a perspective view of an illustrative cup lid, according to one or more embodiments described

FIG. 1 depicts a perspective view of an illustrative cup lid 100, according to one or more embodiments. The lid 100 can have an upper surface 106, and at least one recess 120 formed in the upper surface 106. The upper surface 106 can have any desired shape. For example, the upper surface 106 can have a circular, elliptical, or polygonal in shape. For simplicity and ease of description, embodiments of the cup lid 100 will be further described as having a circular or round shape. The recess 120 can have an arcuate, curved, arched, bowed, bent, or other non-linear shape. For example, the recess 120 can be C-shaped or bow-shaped. One or more openings 144 can be located or otherwise disposed within the recess 120 to allow fluid flow therethrough. As such, the opening 144 can provide a path of fluid communication through the lid 100.

Figure 2:
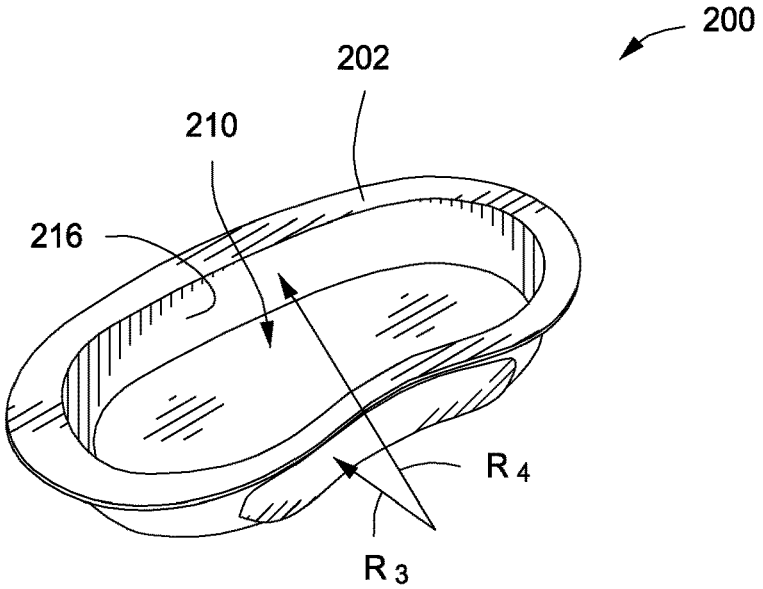
FIG. 2 depicts a perspective view of an illustrative sliding tab that can be at least partially disposed within a recess of the lid shown in FIG. 1, according to one or more embodiments described.

FIG. 2 depicts a perspective view of an illustrative sliding tab 200 that can be at least partially disposed in the recess 120 of the lid 100 shown in FIG. 1, according to one or more embodiments. The tab 200 can have an arcuate, curved, arched, bowed, bent, or other non-linear shape that corresponds to the shape of the recess 120. The tab 200 is shaped to slide or otherwise move within the recess 120. For example, the tab 200 can be moved from one end of the recess 120 to another, thereby regulating fluid flow through the opening 144 while in use. For example, the tab 200 can move from a first or "closed" position to a second or "open" position and all other positions therebetween, all while situated within the recess. In the first or "closed" position, the opening 144 can be completely blocked, not allowing any fluid flow through the opening 144. In the second or "open" position, the opening 144 can be unobstructed or only partially obstructed, allowing fluid flow through the opening 144.

The recess 120 can be substantially arcuate, curved, arched, bowed, and/or bent in shape. The recess 120 can be defined by an inner side wall 126. The depth of the recess 120 relative to the upper surface 106 can be about 0.1 mm, about 0.5 mm, about 1 mm, about 2 mm, about 3 mm, about 4 mm, or about 5 mm to about 6 mm, about 8 mm, about 10 mm, about 15 mm, about 20 mm, or more. For example, the depth can be about 1 mm to about 5 mm, about 2.5 mm to about 7.5 mm, about 5 mm to about 10 mm, about 7.5 mm to about 12.5 mm, or about 1 mm to about 10 mm.

The recess 120 can have a first radius of curvature $R_1$. The first radius of curvature $R_1$ can be about 0.5 cm, about 1 cm, about 1.5 cm, or about 2 cm to about 2.5 cm, about 3 cm, about 3.5 cm, about 4 cm, about 4.5 cm, about 5 cm, or more. For example, the first radius of curvature $R_1$ can be about 0.5 cm to about 1 cm, about 1 cm to about 2 cm, about 2 cm to about 3 cm, about 3 cm to about 4 cm, about 4 cm to about 5 cm, about 1 cm to about 3 cm, or about 1.5 cm to about 2.5 cm.

A ratio of the first radius of curvature $R_1$ to the cross-sectional length 108 of the lid 100 can be about 1:3, about 1:4, about 1:5, or about 1:6 to about 1:7, about 1:8, about 1:9, or about 1:10. For example, the ratio of the first radius of curvature $R_1$ to the cross-sectional length 108 of the lid 100 can be about 1:3 to about 1:5, about 1:4 to about 1:6, about 1:5 to about 1:7, about 1:6 to about 1:8, or about 1:3 to about 1:8. In another example, the ratio of the first radius of curvature $R_1$ to the cross-sectional length 108 of the lid 100 can be at least 1:3, at least 1:3.3, at least 1:3.5, at least 1:3.7, at least 1:4, at least 1:4.3, at least 1:4.5, at least 1:4.7, or at least 1:5 and less than 1:8, less than 1:7.5, less than 1:7, less than 1:6.5, or less than 1:6.

The recess 120 can have a second radius of curvature $R_2$. The second radius of curvature $R_2$ can be about 1 cm, about 1.5 cm, about 2 cm, about 2.5 cm, or about 3 cm to about 3.5 cm, about 4 cm, about 4.5 cm, about 5 cm, about 7.5 cm, about 10 cm, or more. The second radius of curvature $R_2$ can also be about 1 cm to about 2 cm, about 2 cm to about 3 cm, about 3 cm to about 4 cm, about 4 cm to about 5 cm, or about 2 cm to about 5 cm.

A ratio of the second radius of curvature $R_2$ to the cross-sectional length 108 of the lid 100 can be about 1:2.25, about 1:2.5, about 1:2.75, or about 1:3 to about 1:3.5, about 1:4, about 1:4.5, or about 1:5. For example, the ratio of the second radius of curvature $R_2$ to the cross-sectional length 108 of the lid 100 can be about 1:2.25 to about 1:2.75, about 1:2.5 to about 1:3, about 1:2.75 to about 1:3.5, about 1:3 to about 1:4, or about 1:2.25 to about 1:4. In another example, the ratio of the second radius of curvature $R_2$ to the cross-sectional length 108 of the lid 100 can be at least 1:2.25, at least 1:2.3, at least 1:2.35, at least 1:2.4, at least 1:2.45, at least 1:2.5, at least 1:2.55, at least 1:2.6, or at least 1:2.65 and less than 1:4, less than 1:3.7, less than 1:3.5, less than 1:3.3, less than 1:3, less than 1:2.9, or less than 1:2.7.

The ratio of the first radius of curvature $R_1$ to the second radius of curvature $R_2$ can be about 1:1.1, about 1:1.25, about 1:1.5, about 1:1.75, or about 1:2 to about 1:2.5, about 1:3, about 1:3.5, or about 1:4. For example, the ratio of the first radius of curvature $R_1$ to the second radius of curvature $R_2$ can be about 1:1.1 to about 1:1.25, about 1:1.25 to about 1:1.75, about 1:1.5 to about 1:2, or about 1:1.75 to about 1:2.5. In another example, the ratio of the first radius of curvature $R_1$ to the second radius of curvature $R_2$ can be at least 1:1.1, at least 1:1.2, at least 1:1.4, at least 1:1.5, at least 1:1.7, at least 1:2, at least 1:2.3, at least 1:2.5, or at least 1:2.7 and less than 1:4, less than 1:3.7, less than 1:3.5, less than 1:3.3, or less than 1:3.

The width of the recess 120, as measured by $R_2-R_1$, can be about 0.5 cm, about 0.6 cm, about 0.7 cm, about 0.8 cm, about 0.9 cm, about 1 cm, about 1.1 cm, about 1.25 cm, or about 1.5 cm to about 1.75 cm, about 2 cm, about 2.25 cm, about 2.5 cm, about 2.75 cm, about 3 cm, or more. For example, the width of the recess 120 can be about 0.5 cm to about 1 cm, about 0.6 cm to about 1.4 cm, about 1 cm to about 2 cm, about 1.3 cm to about 2.5 cm, or about 2 cm to about 3 cm.

A ratio of the width of the recess 120 to the cross-sectional length 108 of the lid 100 can be about 1:2, about 1:2.25, about 1:2.5, about 1:2.75, or about 1:3 to about 1:3.25, about 1:3.5, about 1:3.75, about 1:4, about 1:4.5, or about 1:5. For example, the ratio of the width of the recess 120 to the cross-sectional length 108 can be about 1:2 to about 1:2.5, about 1:2.5 to about 1:3, about 1:3 to about 1:3.5, about 1:3.5 to about 1:4, or about 1:2.5 to about 1:3.5. In another example, the ratio of the width of the recess 120 to the cross-sectional length 108 can be at least 1:2, at least 1:2.1, at least 1:2.2, at least 1:2.3, at least 1:2.45, at least 1:2.55, at least 1:2.65, at least 1:2.8, at least 1:2.9, or at least 1:3.1 and less than 1:5, less than 1:4.7, less than 1:4.5, less than 1:4.3, or less than 1:4.

The recess 120 can extend along at least a portion of the perimeter or circumference of the upper surface 106. The recess 120 can extend along about 3%, about 5%, about 7%, about 10%, about 15%, about 20%, about 25%, about 30%, about 35%, or about 40% to about 60%, about 65%, about 70%, about 75%, about 80%, about 85%, about 90%, about 95%, or about 100% of the perimeter of the upper surface 106. If the recess 120 extends along 100% of the perimeter of the upper surface 106 the recess 120 would be continuous, e.g., annular in shape.

The opening 144 can have a circular shape, an elliptical shape, a polygonal shape such as a triangle, a square, a rectangle, or a trapezoid, or any combination thereof. The size or area of the opening 144 can be about 10 $mm^2$, about 25 $mm^2$, about 50 $mm^2$, about 75 $mm^2$, or about 100 $mm^2$ to about 125 $mm^2$, about 150 $mm^2$, about 175 $mm^2$, about 200 $mm^2$, or more. For example, the size of the opening 144 can be about 25 $mm^2$ to about 75 $mm^2$, about 50 $mm^2$ to about 100 $mm^2$, about 75 $mm^2$ to about 125 $mm^2$, about 100

$mm^2$ to about 150 $mm^2$, about 125 $mm^2$ to about 175 $mm^2$, about 150 $mm^2$ to about 200 $mm^2$, or about 50 $mm^2$ to about 200 $mm^2$.

The opening 144 can be positioned in the middle or any other suitable location within the recess 120. The opening 144 can be positioned at or approximate the inner side wall 126 within the first recess 120. A distance 146 between the opening 144 and the inner side wall 126 can be about 0.1 mm, about 0.5 mm, about 1 mm, about 1.5 mm, about 2 mm, or about 2.5 mm to about 3 mm, about 4 mm, about 5 mm, about 6 mm, about 7 mm, or more. For example, the distance 146 between the opening 144 and the inner side wall 126 can be about 1 mm to about 3 mm, about 2 mm to about 4 mm, about 3 mm to about 5 mm, about 4 mm to about 6 mm, about 5 mm to about 7 mm, or about 1 mm to about 7 mm. The opening 144 can also be up against or part of the inner side wall 126. As such, at least a portion of the opening 144 can be disposed through the inner side wall 126.

The lid 100 can also include one or more second recesses (one is shown 150) within the upper surface 106. The depth of the second recess 150 relative to the upper surface 106 can be about 1 mm, about 2 mm, about 3 mm, about 4 mm, or about 5 mm to about 6 mm, about 8 mm, about 10 mm, about 15 mm, about 20 mm, or more. For example, the depth of the second recess 150 can be about 1 mm to about 5 mm, about 2.5 mm to about 7.5 mm, about 5 mm to about 10 mm, about 7.5 mm to about 12.5 mm, or about 1 mm to about 10 mm. The depth of the second recess 150 can be the same or different than the depth of the first recess 120 relative to the upper surface 106 of the lid 100.

The second recess 150 can provide or serve as a "nose relief." In other words, the second recess 150 can be shaped and sized to provide space for a user's nose when the user takes a drink from the opening 144 in the lid 100. This can prevent or reduce the tendency for the user's nose to compress or otherwise contact the lid 100 while drinking. The lid 100 can also have one or more vent holes (not shown) formed therethrough. For example, the vent hole can be located or otherwise disposed within the recess 150 to allow fluid flow therethrough. In another example, the vent hole can be located or otherwise disposed within the upper surface 106.

The lid 100 can also include a sidewall 104 that can be attached or otherwise disposed on the upper surface 106. The sidewall 104 can taper away or downwardly from the upper surface 106. The sidewall 104 can be substantially parallel to a central longitudinal axis of the lid 100 (e.g., the sidewall 104 can have a cylindrical shape). Alternatively, the sidewall 104 can taper outwardly from the upper surface 106. For example, the sidewall 104 can be frustoconical such that a cross-sectional length of diameter of the sidewall 104 increases as the sidewall 104 extends away from the upper surface 106.

The lid 100 can also include a base 102 that extends from the sidewall 104. For example, the base 102 can extend outwardly in a substantially perpendicular direct away from a bottom or lower end of the sidewall 104. The lid 100 can also include an outer rim 103 that extends from the base 102. For example, the outer rim 103 can extend outwardly and downwardly from the base 102. The base 102 and/or the rim 103 can be the widest part of the lid 100. A cross-sectional length 108 of the lid 100 can be about 5 cm, about 6 cm, about 7 cm, or about 8 cm, about 9 cm, about 10 cm, about 12.5 cm, about 15 cm, about 20 cm, or more. For example, the cross-sectional length 108 can be about 5 cm to about 10 cm, about 7.5 cm to about 12.5 cm, about 8 cm to about 10 cm, about 9 cm to about 12 cm, or about 10 cm to about 15 cm.

Referring to FIG. 2, the tab 200 can be shaped and sized to fit at least partially within recess 120 in the lid 100. The tab 200 can include an upper surface 202 that extends across a length and width of the tab 200. The upper surface 202 can be substantially flat. The upper surface 202 can have a width about 0.5 mm, about 0.75 mm, about 1 mm, about 1.25 mm, or about 1.5 mm to about 2 mm, about 3 mm, about 4 mm, about 5 mm, or more.

The tab 200 can also include a recess 210 formed in the upper surface 202. The recess 210 can be substantially arcuate, curved, arched, bowed, bent, or other non-linear shape in shape. The recess 210 can be defined by an inner side wall 216. The depth of the recess 210 relative to the upper surface 202 can be any suitable distance. For example, the depth of the recess 210 can be about 1 mm, about 2 mm, about 3 mm, about 4 mm, or about 5 mm to about 6 mm, about 8 mm, about 10 mm, about 15 mm, about 20 mm, or more. The depth of the recess 210 can also be about 1 mm to about 5 mm, about 2.5 mm to about 7.5 mm, about 5 mm to about 10 mm, about 7.5 mm to about 12.5 mm, or about 1 mm to about 10 mm. The depth of recess 210 in the tab 200 can be the same or different than the depth of recess 120 in the lid 100.

The tab 200 can also have a first radius of curvature $R_3$. The first radius of curvature $R_3$ can be about 0.5 cm, about 1 cm, about 1.5 cm, or about 2 cm to about 2.5 cm, about 3 cm to about 3.5 cm, about 4 cm, about 4.5 cm, about 5 cm, or more. In certain embodiments, the first radius of curvature $R_3$ can be the same or substantially correspond to the first radius of curvature $R_1$ of recess 120 formed in the upper surface 106 of the lid 100 (see FIG. 1).

The tab 200 can also have a second radius of curvature $R_4$. The radius of curvature $R_4$ can be about 1 cm, about 1.5 cm, about 2 cm, about 2.5 cm, or about 3 cm to about 3.5 cm, about 4 cm, about 4.5 cm, about 5 cm, about 7.5 cm, about 10 cm, or more. In certain embodiments, the second radius of curvature $R_4$ can be the same or substantially correspond to the radius of curvature $R_2$ of recess 120 formed in the upper surface 106 of the lid 100 (see FIG. 1).

The ratio of the first radius of curvature $R_3$ to the second radius of curvature $R_4$ of the tab 200 can be about 1:1.1, about 1:1.25, about 1:1.5, about 1:1.75, or about 1:2 to about 1:2.5, about 1:3, about 1:3.5, or about 1:4. For example, the ratio of the first radius of curvature $R_3$ to the second radius of curvature $R_4$ can be about 1:1.1 to about 1:1.25, about 1:1.25 to about 1:1.75, about 1:1.5 to about 1:2, or about 1:1.75 to about 1:2.5. In another example, the ratio of the first radius of curvature $R_3$ to the second radius of curvature $R_4$ can be at least 1:1.1, at least 1:1.2, at least 1:1.4, at least 1:1.5, at least 1:1.7, at least 1:2, at least 1:2.3, at least 1:2.5, or at least 1:2.7 and less than 1:4, less than 1:3.7, less than 1:3.5, less than 1:3.3, or less than 1:3.

The tab 200 can have any suitable width, as measured by $R_4-R_3$. For example, the width of the tab 200 can be about 0.5 cm, about 0.75 cm, about 1 cm, about 1.25 cm, or about 1.5 cm to about 1.75 cm, about 2 cm, about 2.25 cm, about 2.5 cm, about 2.75 cm, about 3 cm, or more. The width of the tab 200 can also be about 0.5 cm to about 1 cm, about 1 cm to about 2 cm, or about 2 cm to about 3 cm.

Figure 3:
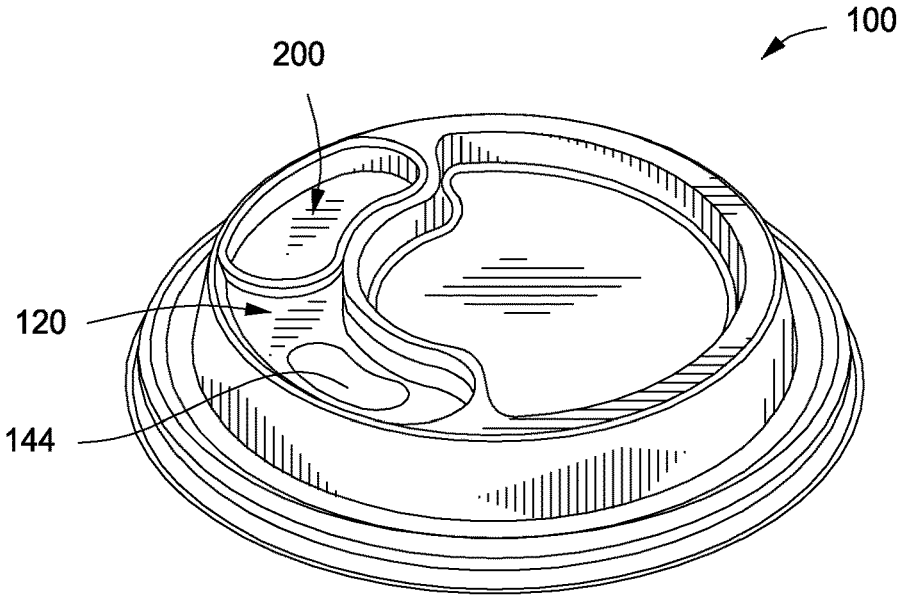
FIG. 3 depicts a perspective view of the sliding tab of FIG. 2 at least partially disposed within a recess of the lid shown in FIG. 1 such that the lid is in an open position, according to one or more embodiments described.

FIG. 3 depicts a perspective view of the tab 200 of FIG. 2 at least partially disposed within recess 120 of the lid 100 such that the lid 100 is in the open position, according to one or more embodiments. The tab 200 can be adapted to move or slide within recess 120 in the lid 100. As shown, the tab 200 is disposed within the recess 120 opposite the location of the opening 144. When in this position, the tab 200 the opening 144 is at least partially unobstructed. As such, lid 100 is in an open position allowing a user to drink from a cup secured to the lid 100 and containing a liquid therein, through the opening 144 in the lid 100.

Figure 4:
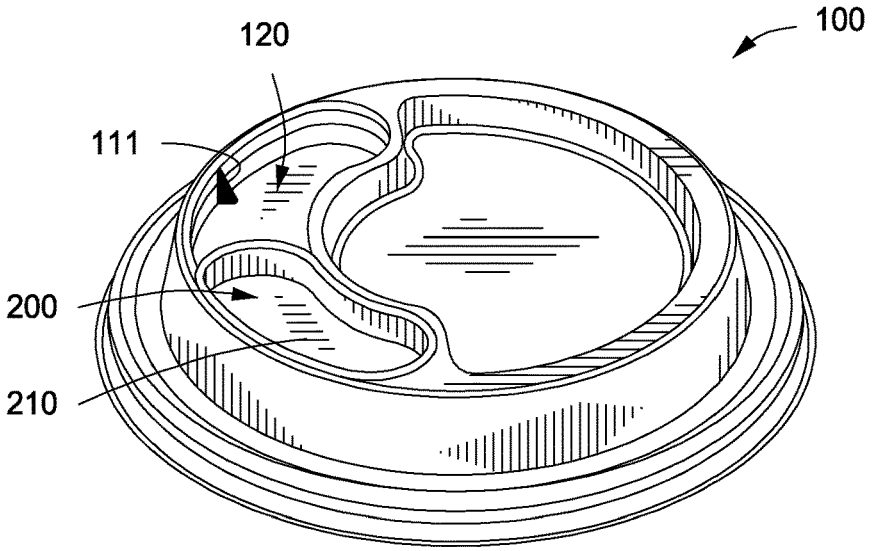
FIG. 4 depicts a perspective view of the sliding tab of FIG. 2 at least partially disposed within a recess of the lid shown in FIG. 1 such that the lid is in a closed position, according to one or more embodiments described.

FIG. 4 depicts a perspective view of the tab 200 of FIG. 2 at least partially disposed within recess 120 of the lid 100 such that the lid 100 is in the closed position, according to one or more embodiments. To prevent or reduce the tendency of the liquid from spilling, splashing, or otherwise flowing through the opening 144 in the lid 100, the user can slide tab 200 along a path of recess 120 into a position that at least partially obstructs the opening 144 or completely blocks off the opening 144, i.e., the closed position. To slide the tab 200, the user can put his or her finger in recess 210 of tab 200 and pull or push the tab 200 within the recess 120 in the lid 100. The tab 200 can also include one or more manipulating arms (not shown) extending therefrom. The manipulating arm can enable a user to slide the tab 200 with his or her finger. When in this position tab 200 obstructs the opening 144. As such, the lid 100 is in a closed position, and fluid flow is restricted through the opening 144 in the lid 100.

In at least one embodiment, the tab 200 can include a protrusion 211 (see FIG. 6) extending from the lower surface thereof that is shaped and sized to fit within the opening 144 to improve the seal between the tab 200 and the lid 100. The recess 120 can include one or more protrusions 111 designed to engage the tab 200 in one or more predetermined locations. The one or more protrusions 111 in the recess 120 can extend from any location within the recess 120. The one or more protrusions 111 can be of any size and shape to provide auditory or tactile information to a user to indicate a position of the tab 200 relative the opening 144 when the tab 200 engages the one or more protrusions.

Figure 5:
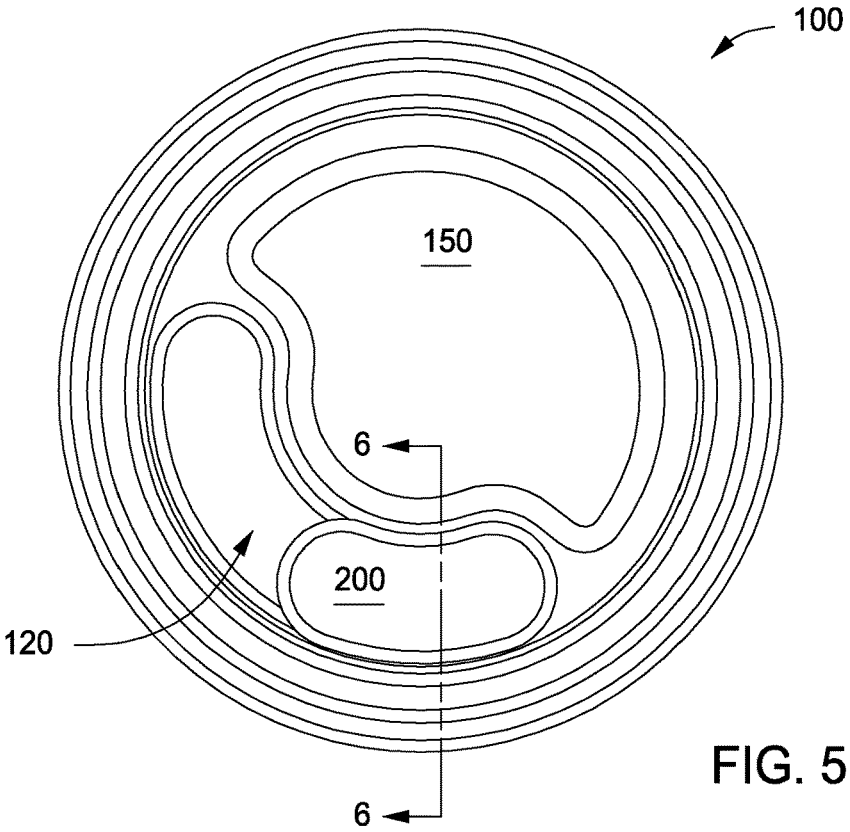
FIG. 5 depicts a top view of the lid shown in FIG. 4, according to one or more embodiments described.
Figure 6:
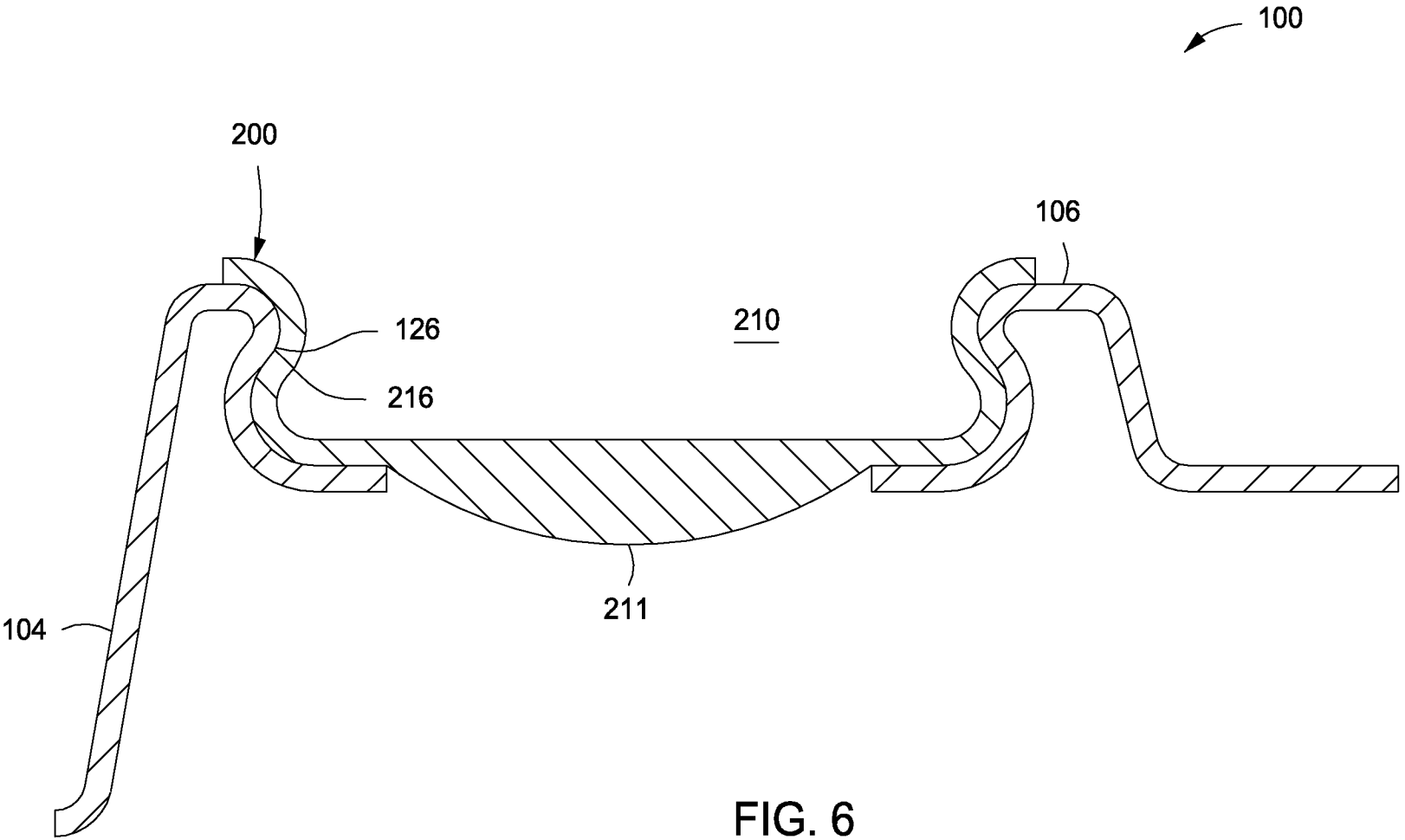
FIG. 6 depicts a cross-sectional view of the lid taken along lines 6-6 in FIG. 5.

FIG. 5 depicts a top view of the lid 100 in the closed position, and FIG. 6 depicts a cross-sectional view of the lid 100 taken along the lines 6-6 in FIG. 5. As shown, the tab 200 can be secured within recess 120 in the lid 100 via a snap-fit connection or any other suitable connection. The width of the tab 200 can be less than, equal to, and/or greater than the width of the recess 120. The width of the tab 200 can be adapted to provide a friction or snap-fit connection between the tab 200 and the lid 100 when the tab 200 is at least partially disposed within the recess 120. For example, an exterior or outer perimeter of the inner sidewall 216 can be adapted to contact the inner sidewall 126 of the recess 120 such that the tab 200 can be at least partially disposed in and secured therein via a friction or snap-fit connection. The friction or snap-fit connection between the tab 200 and the inner sidewall 126 of the recess 120 can be sufficient to hold or otherwise maintain the tab 200 in the recess 120, but weak enough to permit the tab 200 to move within the recess 126 between the first and second positions when a force is exerted on the tab 200, e.g., by a user.

Figure 7:
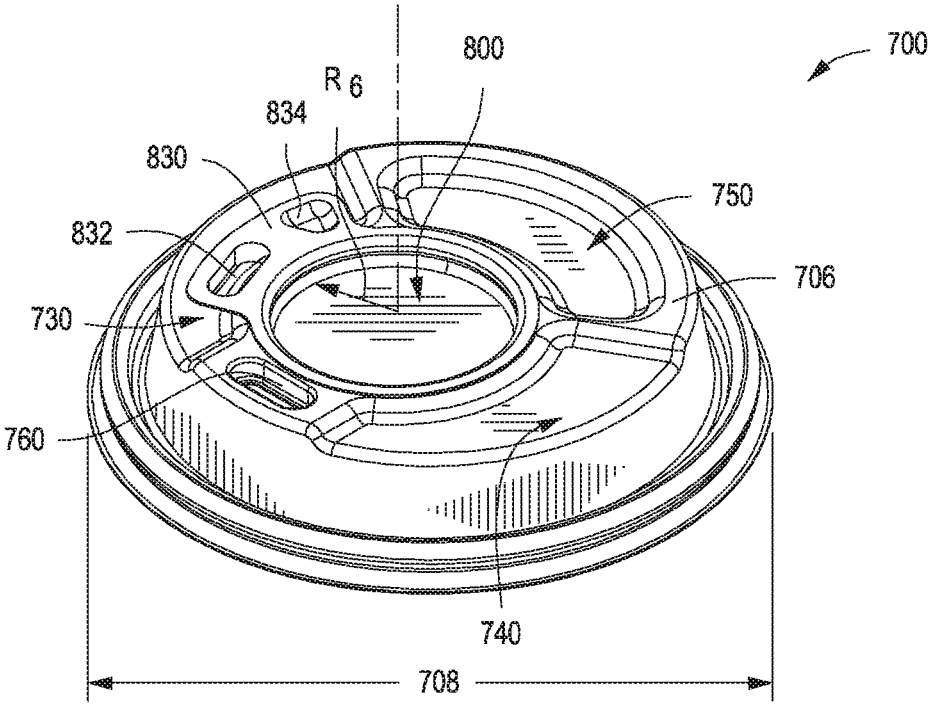
FIG. 7 depicts a perspective view of another illustrative lid in an open position, according to one or more embodiments described.

FIG. 7 depicts a perspective view of another illustrative lid 700 in an open position, according to one or more embodiments. The lid 700 has a different recess and tab configuration than the lid 100. As shown in FIG. 7, the lid 700 can have an upper surface 706, and at least one recess 720 (see FIG. 10) formed in the upper surface 706. The upper surface 706 can have any desired shape. For example, the upper surface 706 can have a circular, elliptical, or polygonal in shape. The recess 720 can be substantially circular. A tab 800 is configured to fit within the recess 720. The tab 800 can have a substantially circular shape that corresponds to the substantially circular shape of the recess 720. One or more openings 760 can be located or otherwise disposed within the recess 720 to allow fluid flow therethrough. The tab 800 is shaped to rotate or otherwise move within the recess 720. For example, the tab 800 can be rotated within the recess 720, thereby regulating fluid flow through the opening 760 while in use. For example, the tab 800 can rotate from a first or "closed" position to a second or "open" position and all other positions therebetween, all while situated within the recess. In the first or "closed" position, the opening 760 can be completely blocked, not allowing any fluid through the opening 760. In the second or "open" position, the opening 760 can be unobstructed, or only partially obstructed, allowing fluid flow through the opening 760.

The upper surface 706 can be substantially flat. The depth of the recess 720 relative to the upper surface 706 can be any suitable distance. For example, the depth of the recess 720 can be substantially the same or different than the depth of recess 120 previously described.

Figure 10:
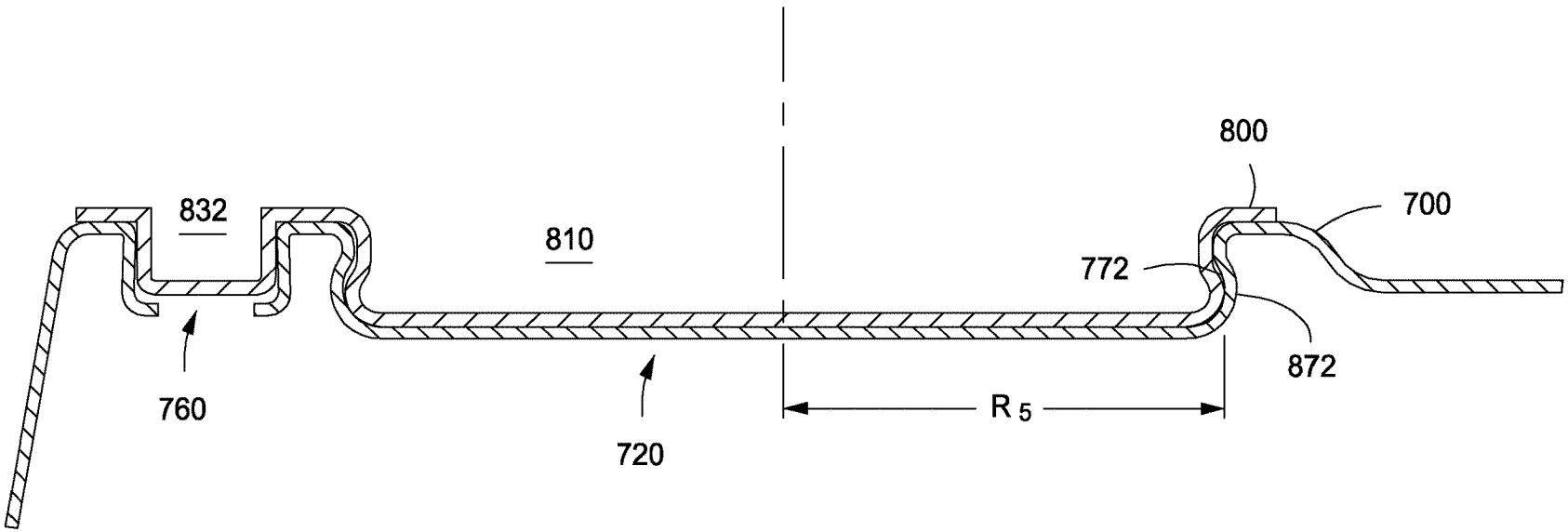
FIG. 10 depicts a cross-sectional view of the lid taken along lines 10-10 in FIG. 9.

The recess 720 can have any suitable radius $R_5$ (shown in FIG. 10). The radius $R_5$ can be about 0.5 cm, about 1 cm, about 1.5 cm, or about 2 cm to about 2.5 cm, about 3 cm to about 3.5 cm, about 4 cm, about 4.5 cm, about 5 cm, or more. For example, the radius $R_5$ can be about 0.5 cm to about 1 cm, about 1 cm to about 2 cm, about 2 cm to about 3 cm, about 3 cm to about 4 cm, about 4 cm to about 5 cm, about 1 cm to about 3 cm, or about 1.5 cm to about 2.5 cm.

A ratio of the radius $R_5$ to the cross-sectional length 708 of the base of the lid 700 can be about 1:3, about 1:4, about 1:5, or about 1:6 to about 1:7, about 1:8, about 1:9, or about 1:10. For example, the ratio can be about 1:3 to about 1:5, about 1:4 to about 1:6, about 1:5 to about 1:7, about 1:6 to about 1:8, or about 1:3 to about 1:8.

The upper surface 706 of lid 700 can further have second, third, and fourth recesses 730, 740, 750 circumferentially offset from one another. The second, third, and fourth recesses 730, 740, 750 can be arcuate, straight, or any other suitable shape. As shown, the second, third, and fourth recesses 730, 740, 750 are substantially arcuate in shape. The depth of the second, third, and fourth recesses 730, 740, 750 relative to the upper surface 706 can be any suitable distance. The depth can be about 1 mm, about 2 mm, about 3 mm, about 4 mm, or about 5 mm to about 6 mm, about 8 mm, about 10 mm, about 15 mm, about 20 mm, or more. For example, the depth can be about 1 mm to about 5 mm, about 2.5 mm to about 7.5 mm, about 5 mm to about 10 mm, about 7.5 mm to about 12.5 mm, or about 1 mm to about 10 mm. The depth of the recess 720, 730, 740, and 750 can be substantially the same or different.

The second recess 730, the third recess 740, and/or the fourth recess 750 can extend along at least a portion of the perimeter or circumference of the upper surface 706. More particularly, the second recess 730, the third recess 740, and/or the fourth recess 750 can extend along about 3%, about 5%, about 7%, about 10%, about 15%, about 20%, about 25%, about 30%, about 35%, or about 40% to about 60%, about 65%, about 70%, about 75%, about 80%, about 85%, about 90%, about 95%, or about 100% of the perimeter of the upper surface 706.

The upper surface 706 can include an opening 760 that provides a path of fluid communication through the upper surface 706 and the lid 700. The opening 760 can be positioned radially outward from recess 720. The opening 760 can also be positioned circumferentially between the second and third recesses 730, 740.

The opening 760 can have a shape that is a circle, an oval, a square, a rectangle, a trapezoid, or combinations thereof. The opening 760 can be any suitable size. The size of the opening 760 can be about 25 $mm^2$, about 50 $mm^2$, about 75 $mm^2$, or about 100 $mm^2$ to about 125 $mm^2$, about 150 $mm^2$, about 175 $mm^2$, about 200 $mm^2$, or more. For example, the size can be about 25 $mm^2$ to about 75 $mm^2$, about 50 $mm^2$ to about 100 $mm^2$, about 75 $mm^2$ to about 125 $mm^2$, about 100 $mm^2$ to about 150 $mm^2$, about 125 $mm^2$ to about 175 $mm^2$, about 150 $mm^2$ to about 200 $mm^2$, or about 50 $mm^2$ to about 200 $mm^2$.

The lid 700 can further include a rotating tab 800 disposed within the recess 720. The tab 800 can include an extension 830. The tab 800 can be shaped and sized to fit within the recess 720. The tab 800 can include a tab recess 810 (see FIG. 10). The depth of the recess 810 relative to an upper surface of the tab 800 can be the substantially the same or different than the depth of recess 210 previously described.

The tab 800 can have a radius $R_6$. The $R_6$ can be about 0.5 cm, about 1 cm, about 1.5 cm, or about 2 cm to about 2.5 cm, about 3 cm to about 3.5 cm, about 4 cm, about 4.5 cm, about 5 cm, or more. For example, the radius of curvature $R_6$ can be about 0.5 cm to about 1 cm, about 1 cm to about 2 cm, about 2 cm to about 3 cm, about 3 cm to about 4 cm, about 4 cm to about 5 cm, about 1 cm to about 3 cm, or about 1.5 cm to about 2.5 cm. The radius $R_5$ of the recess 720 and the $R_6$ of the tab recess can be substantially the same or different.

The extension 830 can extend radially outward from the tab 800. The extension 830 can include one or more recesses 832, 834. The recess 832 can have a shape that corresponds to the opening 760 in the upper surface 706 of the lid 700. The recess 832 can be adapted to cover or at least partially fit within the opening 760 in the upper surface 706 of the lid 700 when the lid 700 is in a closed position to create a seal.

The recess 834 can be circumferentially offset from recess 832. The recess 834 can be shaped and sized to receive or be manipulated by a user's finger. The user can place his or her finger into the second recess 834 and rotate the tab 800 with respect to the lid 700. As shown in FIG. 7, the extension 830 of the tab 800 is circumferentially offset from the opening 760 in the lid 700. As such, the user can drink from a cup through the opening 760 in the lid 700. The lid 700 is referred to as being in an open position when the tab 800 is positioned in this manner.

Figure 8:
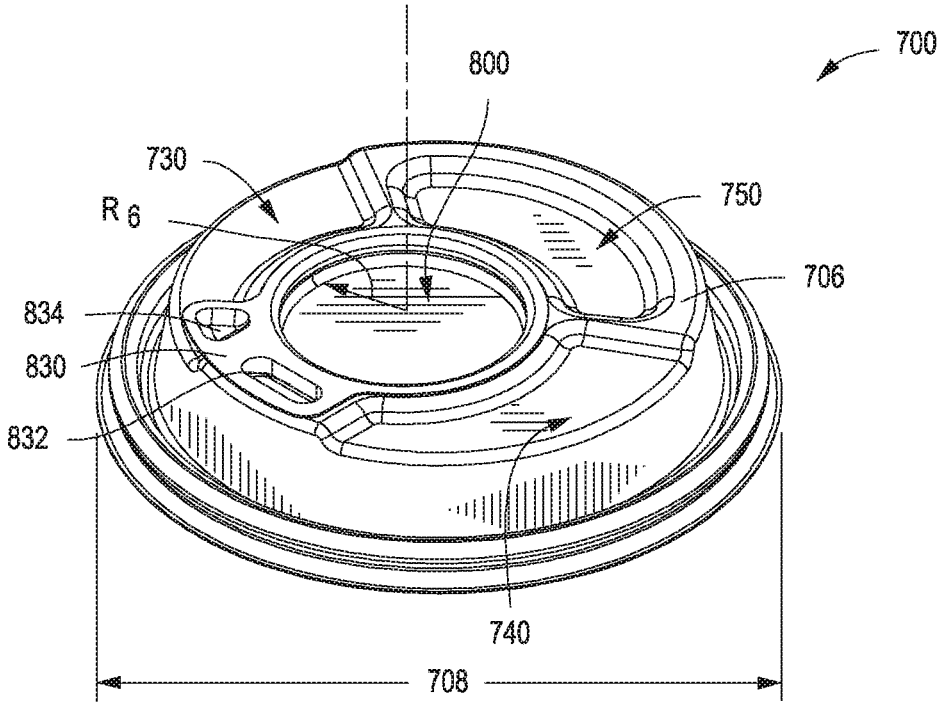
FIG. 8 depicts a perspective view of the lid shown in FIG. 7 in a closed position, according to one or more embodiments described.

FIG. 8 depicts a perspective view of the lid 700 of FIG. 7 in a closed position, according to one or more embodiments. The user can put his or her finger into the first and/or second recess 832, 834 in the extension 830 of the tab 800 and rotate the tab 800 with respect to the lid 700. The tab 800 can be rotated until recess 832 is at least partially aligned with the opening 760 in the lid 700. As such, the extension 830 can prevent the fluid in the cup from spilling, splashing, or otherwise flowing through the opening 760. The lid 700 is referred to as being in a closed position when the tab 800 is positioned in this manner. In at least one embodiment, the recess 832 can fit within the opening 760 when the lid 700 is in the closed position. This can improve the seal between the lid 700 and the tab 800.

Figure 9:
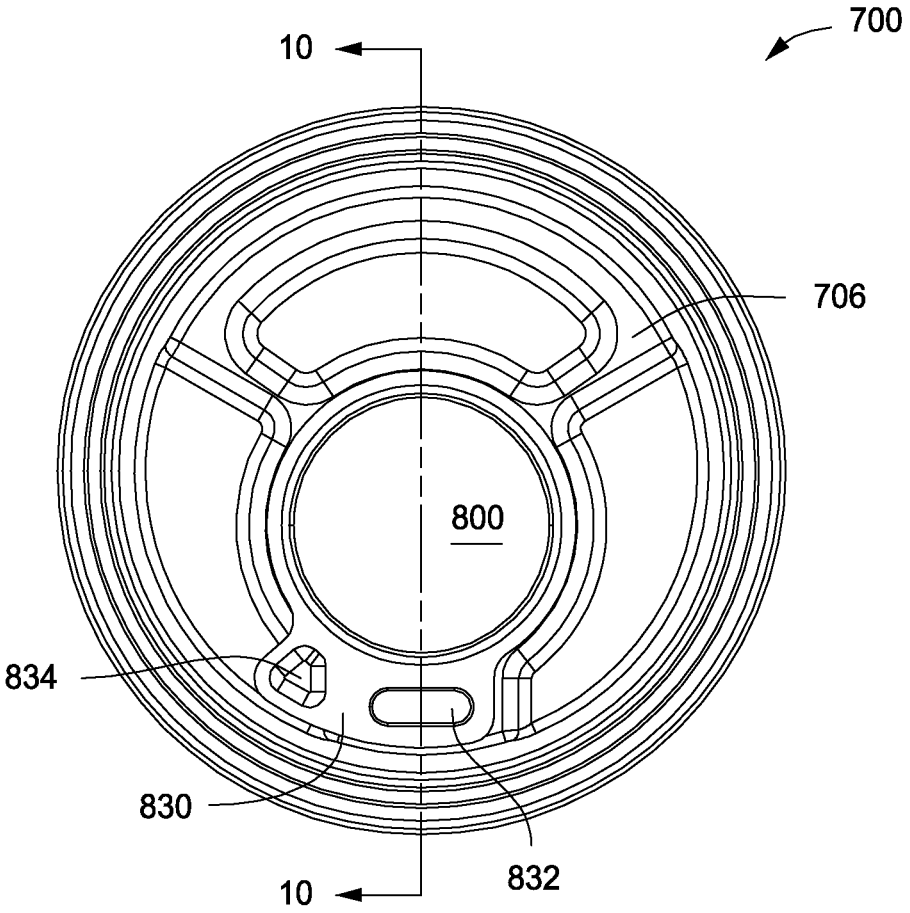
FIG. 9 depicts a top view of the lid shown in FIG. 7, according to one or more embodiments described.

FIG. 9 depicts a top view of the lid 700 of FIG. 7 in the closed position, and FIG. 10 depicts a cross-sectional view of the lid 700 taken along the lines 10-10 in FIG. 9. As shown, the tab 800 can be secured within the first recess 720 of the lid 700 via a snap-fit connection or any other suitable connection. The radius $R_6$ of the tab 800 can be less than, equal to, and/or greater than the radius $R_5$ of the recess 720. The radius $R_6$ of the tab 800 can be adapted to provide a friction or snap-fit connection between the tab 800 and the lid 100 when the tab 800 is at least partially disposed within the recess 720. For example, an exterior or outer surface of tab 800 can include protrusions 872 that contact or otherwise engage protrusions 772 on the inner sidewall of the recess 720 such that the tab 800 can be at least partially disposed in and secured therein via a friction or snap-fit connection. The friction or snap-fit connection between the tab 800 and recess 720 can be sufficient to hold or otherwise maintain the tab 800 in the recess 720, but weak enough to permit the tab 800 to move or rotate within the recess 720 between the first and second positions when a force is exerted on the tab 800, e.g., by a user. The connection can allow the tab 800 to snap into the first recess 720 in the lid 700 manually or by an automated device, and held in place until removed.

Figure 11:
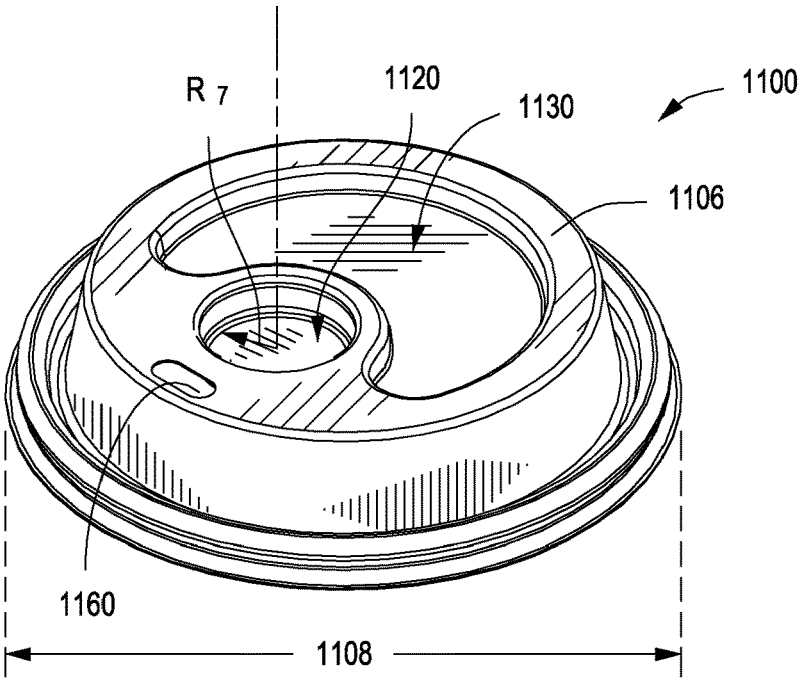
FIG. 11 depicts a perspective view of yet another illustrative lid, according to one or more embodiments described.

FIG. 11 depicts a perspective view of yet another illustrative lid 1100, according to one or more embodiments. The lid 1100 has a different recess and tab configuration than the lids 100 and 700. The lid 1100 can have an upper surface 1106, and at least one recess 1120 formed in the upper surface 1106. The recess 1120 can be substantially circular. A tab 1200 is configured to fit within the recess 1120. The tab 1200 can have a substantially circular shape that corresponds to the substantially circular shape of the recess 1120. One or more openings 1160 can be located or otherwise disposed within the recess 1120 to allow fluid flow therethrough. The tab 1200 is shaped to rotate or otherwise move within the recess 1120. For example, the tab 1200 can be rotated within the recess 1120, thereby regulating fluid flow through the opening 1160 while in use. For example, the tab 1200 can rotate from a first or "closed" position to a second or "open" position and all other positions therebetween, all while situated within the recess. In the first or "closed" position, the opening 1160 can be completely blocked, not allowing any fluid through the opening 1160. In the second or "open" position, the opening 1160 can be unobstructed, or only partially obstructed, allowing fluid flow through the opening 1160.

The upper surface 1106 of the lid 1100 can be substantially flat. The depth of recess 1120 relative to the upper surface 1106 can be any suitable distance. For example, the depth of recess 1120 can be the substantially the same or different than the depth of recess 120 previously described.

The recess 1120 can have a radius $R_7$. The radius $R_7$ can be about 0.5 cm, about 1 cm, about 1.5 cm, or about 2 cm to about 2.5 cm, about 3 cm to about 3.5 cm, about 4 cm, about 4.5 cm, about 5 cm, or more. The radius of curvature $R_7$ can also be about 0.5 cm to about 1 cm, about 1 cm to about 2 cm, about 2 cm to about 3 cm, about 3 cm to about 4 cm, about 4 cm to about 5 cm, about 0.5 cm to about 1.5 cm, or about 1 cm to about 2 cm.

A ratio of the radius $R_7$ to the cross-sectional length 1108 of the base 1120 and/or the lid 1100 can be about 1:3, about 1:4, about 1:5, or about 1:6 to about 1:7, about 1:8, about 1:9, or about 1:10. For example, the ratio can be about 1:4 to about 1:6, about 1:5 to about 1:7, about 1:6 to about 1:8, or about 1:7 to about 1:9, about 1:8 to about 1:10, or about 1:5 to about 1:10.

The upper surface 1106 can further include a second recess 1130. The second recess 1130 can be arcuate, straight, or any other shape. As shown, the second recess 1130 is substantially arcuate in shape. The depth of second recess 1130 relative to the upper surface 1106 can be any suitable distance. For example, the depth of second recess 1130 can be the substantially the same or different than the depth of recess 1120.

The second recess 1130 can provide "nose relief." In other words, the second recess 1130 can be shaped and sized to provide space for a user's nose when the user takes a drink from the lid 1100. This can prevent the user's nose from being compressed by the lid 1100 while drinking.

The upper surface 1106 can include one or more openings 1160 that provides a path of fluid communication through the upper surface 1106 and the lid 1100. The opening 1160 can provide a path for fluid to flow from the cup (not shown) through the lid 1100 to the user when the user takes a drink from the lid 1100. The opening 1160 can be positioned radially outward from recess 1120. The opening 1160 can have a shape that is a circle, an oval, a square, a rectangle, a trapezoid, or combinations thereof. The size of the opening 1160 can be about 25 $mm^2$, about 50 $mm^2$, about 75 $mm^2$, or about 100 $mm^2$ to about 125 $mm^2$, about 150 $mm^2$, about 175 $mm^2$, about 200 $mm^2$, or more. For example, the size can be about 25 $mm^2$ to about 75 $mm^2$, about 50 $mm^2$ to about 100 $mm^2$, about 75 $mm^2$ to about 125 $mm^2$, about 100 $mm^2$ to about 150 $mm^2$, about 125 $mm^2$ to about 175 $mm^2$, about 150 $mm^2$ to about 200 $mm^2$, or about 50 $mm^2$ to about 200 $mm^2$.

Figure 12:
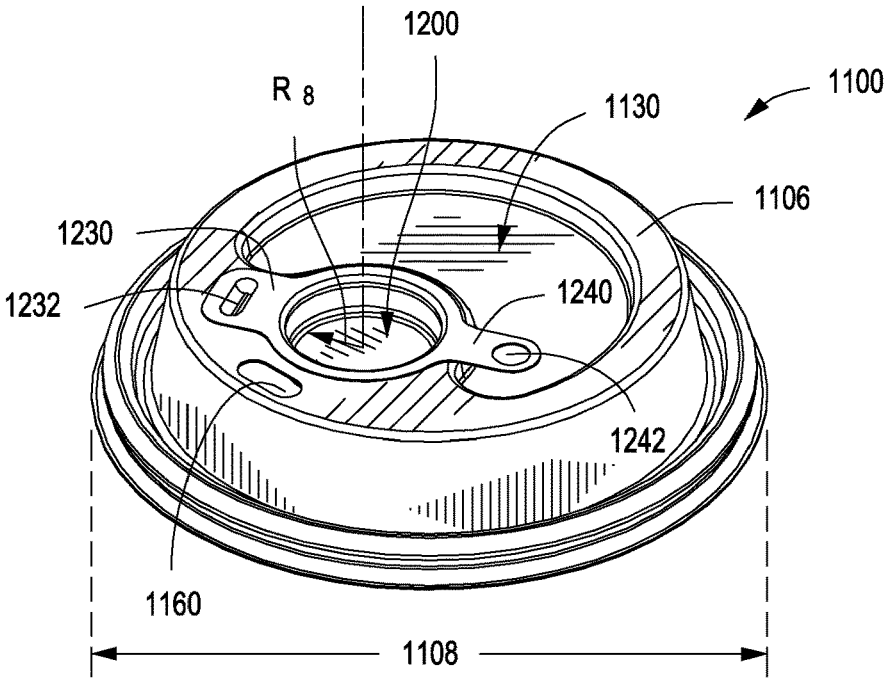
FIG. 12 depicts a perspective view of the lid shown in FIG. 11 having a rotating tab disposed within a recess of the lid shown in FIG. 11 and in an open position, according to one or more embodiments described.

FIG. 12 depicts a perspective view of the lid shown in FIG. 11 in an open position, according to one or more embodiments described. The lid 1100 can include a rotating tab 1200 disposed within the recess 1120. The tab 1200 can include one or more extensions 1230, 1240 that extend radially outward therefrom. The tab can be shaped and sized to fit within recess 1120. The tab 1200 can include a tab recess 1210 (see FIG. 15). The tab recess 1210 can be substantially flat. The depth of the tab recess 1210 relative to an upper surface of the tab 1200 can be about 1 mm, about 2 mm, about 3 mm, about 4 mm, or about 5 mm to about 6 mm, about 8 mm, about 10 mm, about 15 mm, about 20 mm, or more. For example, the depth can be about 1 mm to about 5 mm, about 2.5 mm to about 7.5 mm, about 5 mm to about 10 mm, about 7.5 mm to about 12.5 mm, or about 1 mm to about 10 mm.

The tab 1200 can be circular in shape and have a radius $R_8$. The radius $R_8$ can be about 0.5 cm, about 1 cm, about 1.5 cm, or about 2 cm to about 2.5 cm, about 3 cm to about 3.5 cm, about 4 cm, about 4.5 cm, about 5 cm, or more. For example, the radius $R_8$ can be about 0.5 cm to about 1 cm, about 1 cm to about 2 cm, about 2 cm to about 3 cm, about 3 cm to about 4 cm, about 4 cm to about 5 cm, about 0.5 cm to about 1.5 cm, or about 1 cm to about 2 cm.

The extension 1230 ("first extension" 1230) can include a recess 1232. The recess 1232 can have a shape that is a circle, an oval, a square, a rectangle, a trapezoid, or combinations thereof. The recess 1232 can have a shape that corresponds to the opening 1160 in the upper surface 1106 of the lid 1100. The recess 1232 can be adapted to at least partially fit within the opening 1160 in the upper surface 1106 of the lid 1100 when the lid 1100 is in a closed position.

The second extension 1240 can be circumferentially offset from the first handle 1230 about the body of the tab 1200 by about 180°. The second extension 1240 can also include a recess 1242. The recess 1242 can have any suitable shape or configuration. The recess 1242 can have a shape that is a circle, an oval, a square, a rectangle, a trapezoid, or combinations thereof. The recess 1242 can be shaped and sized to receive a user's finger. The user can place his or her finger into the recess 1242 and rotate the tab 1200 with respect to the lid 1100. As shown in FIG. 12, the first extension 1230 of the tab 1200 is circumferentially offset from the opening 1160 in the lid 1100. As such, the user can drink from a cup through the opening 1160 in the lid 1100. When the tab 1200 is positioned in this manner the lid 1100 is referred to as being in an open position.

Figure 13:
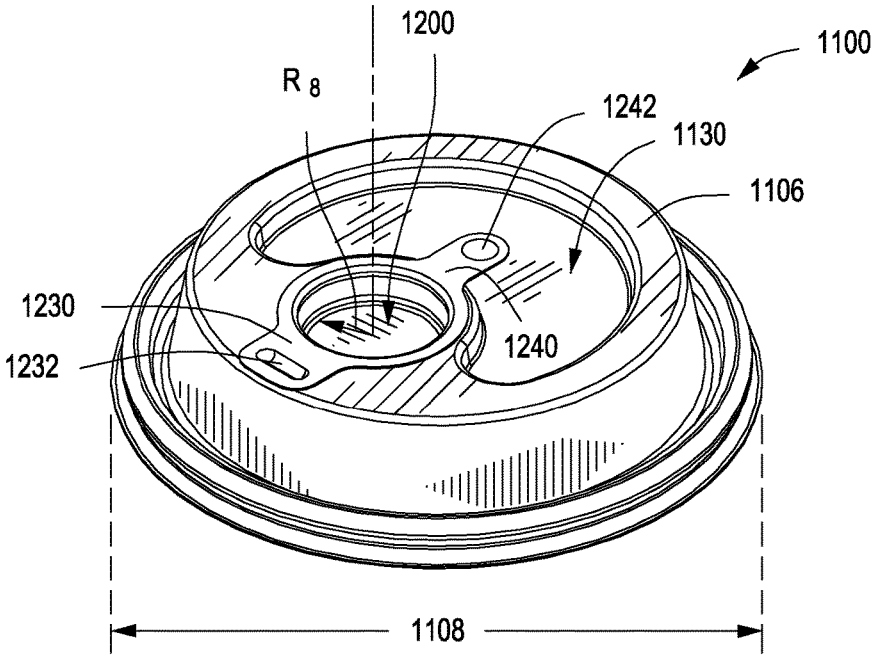
FIG. 13 depicts a perspective view of the lid shown in FIG. 11 having a rotating tab disposed within a recess of the lid shown in FIG. 11 and in a closed position, according to one or more embodiments described.

FIG. 13 depicts a perspective view of the lid 1100 of FIG. 12 in a closed position, according to one or more embodiments. The user can put his or her finger on the second extension 1240 and/or in the recess 1242 and rotate the tab 1200 with respect to the lid 1100. The tab 1200 can be rotated until the recess 1232 is at least partially aligned with the opening 1160 in the lid 1100. As such, the first extension 1230 can prevent the fluid in the cup from spilling, splashing, or otherwise flowing through the opening 1160. When the tab 1200 is positioned in this manner the lid 1100 is referred to as being in a closed position. In at least one embodiment, the recess 1232 can fit within the opening 1160 when the lid 1100 is in the closed position. This can improve the seal between the lid 1100 and the tab 1200.

Figure 14:
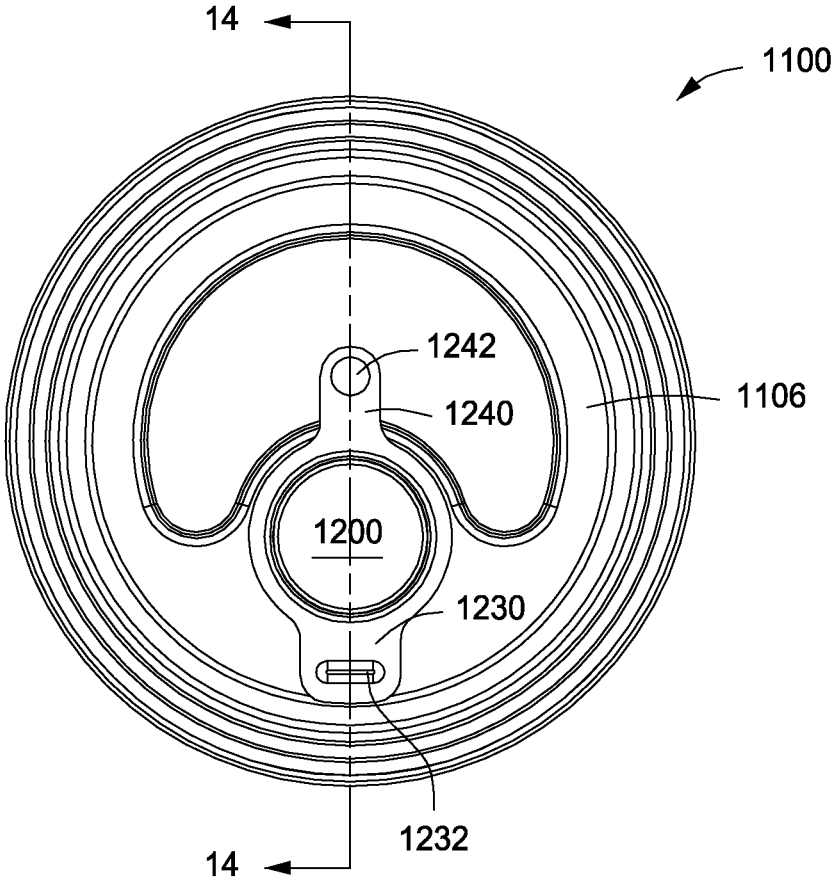
FIG. 14 depicts a top view of the lid shown in FIG. 13 having the rotating tab disposed within the recess of the lid and in the closed position, according to one or more embodiments described.
Figure 15:
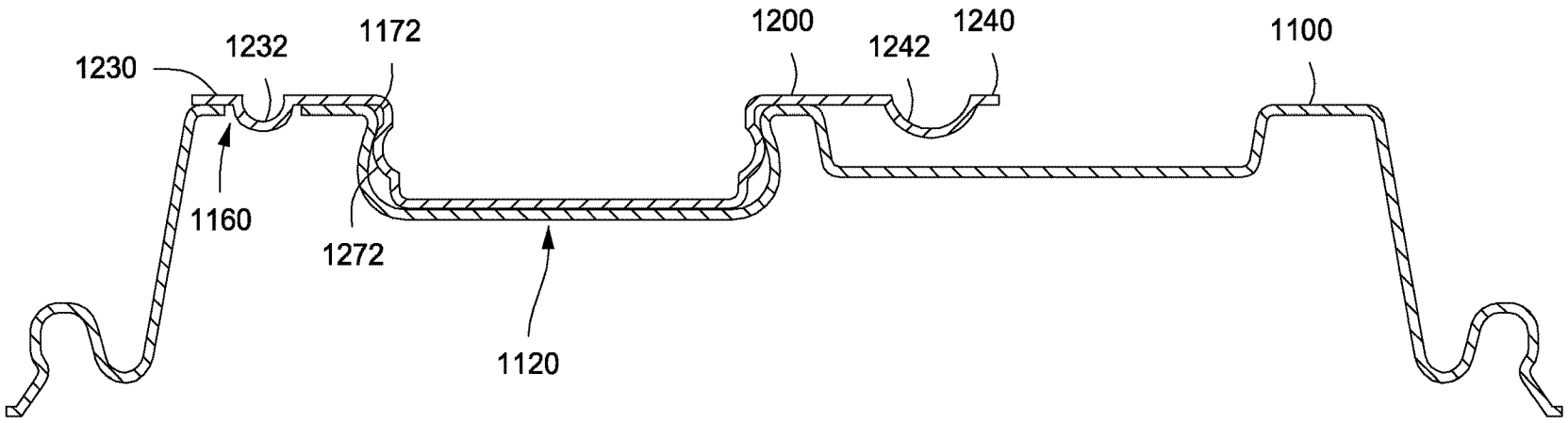
FIG. 15 depicts a cross-sectional view of the lid taken along lines 14-14 in FIG. 14.

FIG. 14 depicts a top view of the lid 1100 in the closed position, and FIG. 15 depicts a cross-sectional view of the lid 1100 taken along lines 14-14 of FIG. 14. Referring to FIGS. 14 and 15, the tab 1200 can be secured within the recess 1120 of the lid 1100 using a friction or snap-fit connection. The radius $R_8$ of the tab 1200 can be less than, equal to, and/or greater than the radius $R_7$ of the recess 1120. The radius $R_8$ of the tab 1200 can be adapted to provide a friction or snap-fit connection between the tab 1200 and the lid 100 when the tab 1200 is at least partially disposed within the recess 1120. For example, an exterior or outer surface of tab 1200 can include protrusions 1272 that contact or otherwise engage protrusions 1172 on the inner sidewall of the recess 1120 such that the tab 1200 can be at least partially disposed in and secured therein via a friction or snap-fit connection. The friction or snap-fit connection between the tab 1200 and recess 1120 can be sufficient to hold or otherwise maintain the tab 1200 in the recess 1120, but weak enough to permit the tab 1200 to move or rotate within the recess 1120 between the first and second positions when a force is exerted on the tab 1200, e.g., by a user. The connection can allow the tab 1200 to snap into the first recess 1120 in the lid 1100 manually or by an automated device, and held in place until removed.

The lids 100, 700, 1100 and the tabs 200, 800, 1200 can be made by thermoforming. Generally speaking, thermoforming is the pressing and/or stretching of heated deformable material into a final shape. Thermoforming is the draping of a softened sheet over a shaped mold. More particularly, thermoforming is the automatic high speed positioning of a heated sheet having an accurately controlled temperature into a pneumatically actuated forming station whereby the article's shape is defined by the mold, followed by trimming and regrind collection as is well known in the art.

Forming techniques other than thermoforming can also be used to manufacture any of the lids 100, 700, 1100 and tabs 200, 800, 1200 disclosed herein. These include variations such as pre-softening the extruded sheet to temperatures below the final melting temperature, cutting flat sections (i.e., blanks) from the sheet, transfer of blanks by gravity or mechanical means into matched molds whereby the blanks are shaped into the article by heat and pressure. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet rolled forming and suitable combinations of the above. Details are provided in J. L. Throne's book, "*Thermoforming*," published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse to simulate a natural or grain like texturized look. Suitable formed articles can be trimmed in line with a cutting die with the trimmings being optionally reused. Other arrangements for productivity enhancements include the simultaneous forming of multiple articles with multiple dies in order to maximize throughput and minimize scrap.

Thermoplastic materials are intended to encompass materials suitable for thermoplastic molding of dome hot cup lids. A material suitable for the lid is a styrene polymer composition, which can be filled or unfilled. The composition can have enough pigment to provide opacity or near opacity. Other suitable materials include one or more polyolefins such as polyethylenes, polypropylenes, and mixtures thereof, polyesters, polyamides, polyacrylates, polysulfones, polyetherketones, polycarbonates, acrylics, polyphenylene sulfides, acetyls, cellulosics, polyether imides, polyphenylene ethers/oxides, styrene maleic anhydride copolymers, styrene acrylonitrile copolymers, polyvinyl chlorides, and engineered resin derivatives thereof. These materials can likewise be filled or unfilled. Fillers for any of the polymeric materials can be any conventional materials, as would be well known to one or ordinary skill in the art.

The lids 100, 700, 1100 and the tabs 200, 800, 1200 can be thermoformed from a sheet of thermoplastic material. Typically, the thermoplastic sheet from which the lids 100, 700, 1100 and the tabs 200, 800, 1200 are made has a caliper of about 10 to about 20 mils (thousandths of an inch), or about 14 to about 19 mils. The sheet from which the blanks have been cut out can be collected from regrind material and can be recyclable. Yet further, the sheet from which the blanks have been cut can be made from virgin material. Yet, still further, the sheet material from which the blanks have been cut can be prepared from a mixture of virgin and regrind material.

Articles that are thermoformed should be designed so as to permit the die section to be parted free of the molded articles without undue interference with the surfaces of the articles. The surfaces of such articles generally include a so-called positive "draft" with respect to the direction in which the die sections are moved during parting to insure that there is little or no interference between the molded article and the interior surfaces of the die sections during parting. Interference between the articles and the dies is commonly known as "negative draft." The draft can be thought of as the difference between the upper lateral span of a mold cavity and that span below it. A positive draft allows the pattern to be pulled cleanly from the mold; however, undercuts inherently have a negative draft.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure can be devised without departing from the basic scope thereof, and the scope thereof is determined by the claims that follow.

What is claimed is:

1. A reclosable cup lid, comprising:

an upper surface having at least one recess formed therein, the at least one recess having curved ends and an arcuate shape;

a tab configured to fit within the recess, the tab having curved ends and an arcuate shape corresponding to the arcuate shape and curved ends of the recess; and an opening disposed within the recess to allow fluid flow therethrough, wherein the tab is able to move within the recess from a first position to a second position so that the opening is at least partially blocked when the tab is located in the first position, and the opening is at least partially unobstructed when the tab is located in the second position, and wherein the tab comprises a protrusion formed on an outer surface thereof, the protrusion provides a friction fit with the recess to maintain the tab within the recess during use.

2. The cup lid of claim 1, wherein the tab slides between the first position and the second position while maintained within the recess.

3. The cup lid of claim 1, wherein the arcuate shape of the recess is C-shaped.

4. The cup lid of claim 1, wherein the tab comprises an upper lip that rests on the upper surface of the lid.

5. The cup lid of claim 1, wherein the opening has an arcuate shape.

6. The cup lid of claim 1, wherein the recess has a first radius of curvature, $R_1$, and a second radius of curvature, $R_2$, and wherein a ratio of $R_1$:$R_2$ is about 1:1.1 to about 1:2.5.

7. The cup lid of claim 1, wherein the tab moves within the recess from the first position to the second position so that the opening is blocked when the tab is located in the first position, and the opening is unobstructed when the tab is located in the second position.

8. The cup lid of claim 1, wherein the tab moves within the recess from the first position to the second position so that the opening is at least partially blocked when the tab is located in the first position, and the opening is unobstructed when the tab is located in the second position.

9. The cup lid of claim 1, wherein the tab has a recessed inner portion surrounded by sidewalls that are generally parallel to the sidewalls of the lid recess.

10. The cup lid of claim 1, wherein the tab has a recessed inner portion surrounded by sidewalls that are generally parallel to the sidewalls of the lid recess, and the tab further has an upper lip extending outwardly from an upper portion of the sidewalls, whereby the upper lip rests on the upper surface of the lid.

11. A reclosable cup lid, comprising:

an upper surface having a first recess formed therein, the first recess having curved ends and an arcuate shape;

a tab configured to fit within the first recess, the tab having curved ends and an arcuate shape corresponding to the arcuate shape and curved ends of the first recess;

a second recess formed within the upper surface that provides a space for a user's nose; and an opening disposed within the first recess to allow fluid flow therethrough, wherein the tab is able to move within the first recess from a first position to a second position so that the opening is at least partially blocked when the tab is located in the first position, and the opening is at least partially unobstructed when the tab is located in the second position.

12. The cup lid of claim 11, wherein the tab comprises a protrusion formed on an outer surface thereof, the protrusion provides a friction fit with the first recess to maintain the tab within the first recess during use.

13. The cup lid of claim 11, wherein the first recess has a first radius of curvature, $R_1$, and a second radius of curvature, $R_2$, and wherein a width of the first recess is $R_2$-$R_1$.

14. The cup lid of claim 13, wherein the width of the first recess is about 0.5 cm to about 3.0 cm.

15. The cup lid of claim 13, wherein a ratio of $R_1$:$R_2$ is about 1:1.1 to about 1:2.5.

16. The cup lid of claim 13, wherein the tab has a first radius of curvature, $R_3$, and a second radius of curvature, $R_4$.

17. The cup lid of claim 16, wherein a ratio of $R_3$:$R_4$ is about 1:1.1 to about 1:2.5.

18. The cup lid of claim 16, wherein a ratio of $R_1$:$R_3$ is substantially 1:1.

19. A reclosable cup lid, comprising:

an upper surface;

a first recess formed within the upper surface, wherein the first recess has curved ends and an arcuate shape, a first radius of curvature, $R_1$, and a second radius of curvature, $R_2$, wherein a ratio of $R_1$:$R_2$ is about 1:1.1 to about 1:2.5;

a tab configured to fit within the first recess, the tab having curved ends and an arcuate shape that correspond to the curved ends and arcuate shape of the first recess and further comprising a first radius of curvature, $R_3$, a second radius of curvature, $R_4$, wherein a ratio of $R_3$:$R_4$ is about 1:1.1 to about 1:2.5;

a second recess formed within the upper surface to provide a space for a user's nose; and an opening disposed within the first recess to allow fluid flow therethrough, wherein the tab is able to move within the first recess from a first position to a second position so that the opening is at least partially blocked when the tab is located in the first position, and the opening is at least partially unobstructed when the tab is located in the second position.

20. The cup lid of claim 19, wherein the arcuate shape of the first recess is C-shaped.

* * * * *